US007441754B2

(12) United States Patent
Trentadue et al.

(10) Patent No.: US 7,441,754 B2
(45) Date of Patent: Oct. 28, 2008

(54) APPARATUS FOR INTRODUCING A GAS INTO A BODY OF LIQUID

(75) Inventors: Frederick Trentadue, Olathe, KS (US); Fredric H. Avers, Lenexa, KS (US); Dan L. Alexander, Mission, KS (US); Rodney S. Mrkvicka, Leawood, KS (US); James A. Bell, Prairie Village, KS (US); Andrew C. McCullough, Raymore, MO (US)

(73) Assignee: Smith & Loveless, Inc., Lenexa, KS (US)

( * ) Notice: Subject to any disclaimer, the term of this patent is extended or adjusted under 35 U.S.C. 154(b) by 204 days.

(21) Appl. No.: 11/262,242

(22) Filed: Oct. 28, 2005

(65) Prior Publication Data

US 2007/0096346 A1 May 3, 2007

(51) Int. Cl.
*B01F 3/04* (2006.01)

(52) U.S. Cl. ..... 261/87; 261/93; 261/120

(58) Field of Classification Search ..... 261/84, 261/85, 87, 91, 93, 120, 122.1, 122.2, DIG. 71
See application file for complete search history.

(56) References Cited

U.S. PATENT DOCUMENTS

| | | | | | |
|---|---|---|---|---|---|
| 1,124,855 | A | * | 1/1915 | Callow et al. | 261/87 |
| 1,383,881 | A | | 7/1921 | Thomas | |
| 2,121,458 | A | * | 6/1938 | Vogelbuseh | 435/255.7 |
| 3,630,498 | A | | 12/1971 | Bielinski | |
| 3,911,064 | A | * | 10/1975 | McWhirter et al. | 261/87 |
| 3,992,491 | A | * | 11/1976 | Ihrig et al. | 261/87 |
| 4,101,286 | A | | 7/1978 | Nagao et al. | |
| 4,165,286 | A | * | 8/1979 | Schreiber et al. | 210/220 |
| 4,193,950 | A | * | 3/1980 | Stockner et al. | 261/87 |
| 4,228,112 | A | * | 10/1980 | Hise | 261/87 |
| 4,229,302 | A | * | 10/1980 | Molvar | 210/220 |
| 4,249,828 | A | * | 2/1981 | Condolios | 366/102 |
| 4,465,645 | A | * | 8/1984 | Kaelin | 261/87 |
| 4,489,016 | A | | 12/1984 | Kriebel | |
| 5,059,358 | A | * | 10/1991 | Tharp | 261/122.2 |

(Continued)

FOREIGN PATENT DOCUMENTS

DE 2023981 A1 11/1971

(Continued)

*Primary Examiner*—Scott Bushey
(74) *Attorney, Agent, or Firm*—Wood, Phillips, Katz, Clark & Mortimer

(57) ABSTRACT

An apparatus for introducing gas into a large body of liquid, including a horizontal frame on ballast adjustable floats, a pressurized gas source, a vertical shaft rotatable about its axis, and a plurality of blades submerged in the liquid and extending radially from a hub on the lower end of the shaft. The blades each have an elastomeric membrane around a longitudinal member, where the longitudinal member is hollow with a closed end and in communication with the pressurized gas source through the shaft on the other end, with openings through its lower side, and the elastomeric membrane has perforations which are spaced from the longitudinal member openings. A drive on the platform rotates the shaft via a ring gear around the shaft with a key connection thereto allowing axial movement therethrough, and an inwardly facing surface supported on bearings. A selectively driven and smaller pinion gear directly engages the ring gear.

12 Claims, 3 Drawing Sheets

U.S. PATENT DOCUMENTS 5,681,509 A 10/1997 Bailey
6,183,706 B1 * 2/2001 King ..... 423/23
6,808,165 B1 10/2004 Sperber, Jr. et al.
7,044,453 B2 * 5/2006 Tharp ..... 261/122.1
2004/0217493 A1 11/2004 Sperber, Jr. et al.

FOREIGN PATENT DOCUMENTS

GB 2259913 A 3/1993

* cited by examiner

APPARATUS FOR INTRODUCING A GAS INTO A BODY OF LIQUID

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to aerating and mixing large bodies of fluid, and more particularly to an apparatus for introducing gas and dissolved gases into a large body of liquid and mixing the fluid of such a body.

BACKGROUND OF THE INVENTION AND TECHNICAL PROBLEMS POSED BY THE PRIOR ART

Aeration and mixing have been used for treating water and other liquids for over a century. During that time various methods, including the following, have been employed:

Compressor/diffusers use a suitable compressor to force gas below the liquid surface and through a diffuser. As the bubbles rise to the surface, gas is transferred from the bubbles to the liquid. Mixing is accomplished via the change in liquid density created by the air and the hydraulic resistance of the bubbles as they travel to the liquid surface. Diffuser types range from coarse bubble to fine bubble diffusers. Coarse bubble systems do not transfer oxygen as efficiently and can be energy-inefficient to operate, when compared to fine bubble systems. Fine bubble diffusers are at first more energy-efficient, but they can become fouled, clogged, or damaged, resulting in decreased air transfer. The fine-bubble diffusers, in particular, are limited in turn-down capability, due to increased fouling problems at lower gas flow rates.

U.S. Pat. No. 3,630,498 to Belinski shows the use of a small, high-speed rotating mixing and aerating element comprised of a pair of horizontal radially extending blades or foils. In operation, a partial vacuum is created in a zone of cavitation, which is formed behind the foils. Gas bubbles which emerge from the blades enter the zone of cavitation and expand due to the reduced pressure around the bubbles. While expanded, the bubbles are shattered by hydraulic forces into smaller bubbles. The shattered bubbles then exit the reduced pressure zone of cavitation and are further reduced in size as they are subjected to ambient pressure. Critical to the Belinski patent is the creation of the zone of cavitation. To create a zone of cavitation in a practical device, the foils must be short (such as 24 inches) and rotated at very high speeds (such as 450 RPM). Such a device is best suited for a smaller area. If the foils are made appreciably longer, the energy cost and physical loads of high-speed rotation quickly becomes prohibitive.

Surface Aerators use motors to drive impellers or blades near the surface. They either lift the water into the air, or aspirate air and inject it just below the surface. Surface aerators generally have a poor air transfer efficiency when compared to fine bubble diffused aeration systems. In other words they consume more horsepower hours of energy for each pound of dissolved oxygen they produce. In addition, mixing from surface aerators is generally limited to liquid near the surface. Also, mixing energy tends to be point loaded at or near the impeller. Localized zones of high shearing forces tend to damage delicate floc structures necessary for proper liquid clarification. Further, they are limited in the length of the shaft overhang, and have a limited shaft bearing life.

Turbine/Spargers aerators use compressors to force and distribute a gas under the liquid surface. They also use a submerged impeller located just above the diffuser (sparger) to shear the bubbles and provide bulk mixing. Disadvantages of turbine spargers are similar to those for surface aerators with the additional disadvantage that the turbine sparger needs a source of compressed gas such as a compressor.

Jet Aerators use a liquid pump and an eductor to entrain gas into the liquid using the Venturi principle, as in U.S. Pat. No. 4,101,286. Jet aerators may be equipped to mix additional gas, liquid, or solid chemicals into the bulk liquid. They are reliable, have good turn down capability, and tend to be good mixers; however, they are inefficient aerators.

Blade Diffusers as taught in Ingram U.S. Pat. No. 1,383,881 (issued Jul. 5, 1921) use a flotation apparatus having rotating blades that dispense gas bubbles into a body of liquid. The design of these blades is dictated, however, by the requirement that they also act as impellers to rotate the blades as well as discharging the gas bubbles. The blades are pitched so that the leading edges are elevated about 45 degrees. As a result, the emerging gas is formed into elongated and then enlarged bubbles, which provide less efficient introduction of the gas into the liquid. In addition, examination of the patent and some research indicates that the blades would rotate in the opposite direction than is indicated in the Ingram Patent. This would result from the upward flow of fluid caused by the fluid lift pump effect of the released gas moving upward toward the liquid surface. Such vertical water flow across the pitched blades would appear to in fact cause rotation opposite that which is indicated in the patent.

Another excellent example of a device for aeration and mixing of large bodies of liquid is taught in U.S. Pat. No. 5,681,509, which teaches an apparatus and method for mixing and introducing gas into a large body of liquid by rotating a plurality of permanently mounted spoke-like discharge members which are below the surface of the liquid body. These members have upwardly facing perforated discharge surfaces through which compressed gas is released up into the liquid. Upward lift is countered by angling the members which are tilted with their leading edges lower than their trailing edges and balancing the rotation speed to achieve substantially zero lift. A control system is provided to change the depth of submergence of the discharge members to regulate dissolved gas infusion rate and speed of member rotation to maintain angle of attack. U.S. Pat. No. 5,681,509 teaches the use of permanently mounted blade members which are self supporting for the load forces encountered and which can prove labor intensive to change if needed, and also teaches the use of a vertically inclining main shaft which, while providing valuable utility in the ability to raise the blade members from the liquid in which they rotate, does require a substantial frame and mechanical structure to support the components allowing for the inclining main shaft.

Of course, the discharge members which have surfaces through which compressed gas may be discharged can face the risk of damage should the air pressure in those members be interrupted. In that case, the higher liquid pressure outside the members could force the liquid into the discharge members, potentially carrying undesirable particulates with it and thereby damaging/clogging the discharge members. U.S. Pat. No. 6,808,165 B1 discloses one advantageous structure for preventing such damage, in which the discharge members (diffuser blades) are attached to a hub mounted on a main shaft that automatically cantilevers out of the fluid should compressed gas supplied to the diffuser blades through the main shaft cease.

The present invention is directed toward overcoming one or more of the problems set forth above.

SUMMARY OF THE INVENTION

In one aspect of the present invention, a blade is provided for an apparatus for introducing gas into a large body of liquid, where the apparatus includes a submergible hub on a rotatable shaft, radially directed connectors on the hub, and a pressurized gas source in communication with the connectors. The blade includes a longitudinal member and a membrane around the longitudinal member. The longitudinal member includes a mount adapted to secure the longitudinal member to one of the connectors of the hub in a radial direction relative to the rotatable shaft, a passage inside the member closed on one end and in communication with the pressurized gas source when secured to one of the connectors, and openings between the passage and the lower side of the longitudinal member. The membrane has perforations which are spaced from the longitudinal member openings whereby the membrane substantially blocks the longitudinal member openings when pressure in the longitudinal member passage is no greater than the pressure outside the membrane.

In one form of this aspect of the present invention, the membrane is elastomeric and its elasticity biases the membrane toward the outer surface of the longitudinal member along substantially the length of the longitudinal member, and clamps rigidly secure the membrane against the longitudinal member around opposite ends of the longitudinal member.

In another form of this aspect of the present invention, the perforations comprise lines of slits in the membrane, wherein no lines of slits are disposed over the longitudinal member openings.

In still another form of this aspect of the present invention, the longitudinal member is tubular with a selected diameter. In a further form, the membrane is an elastomeric sleeve having an unstretched diameter larger than the selected diameter, and clamps secure opposite ends of the sleeve to the longitudinal member. In another further form, the tube is stainless steel.

In yet another form of this aspect of the present invention, the membrane is elastically stretched by a selected pressure differential of the pressurized gas source in the longitudinal member passage over liquid pressure outside the membrane when submerged.

In another aspect of the present invention, an apparatus for introducing gas into a large body of liquid is provided, including a platform supported above the body of liquid, a pressurized gas source, a vertical shaft rotatable about its axis, and a plurality of blades submerged in the liquid and extending radially from the lower end of the shaft. At least one of the blades comprises a longitudinal member and an elastomeric membrane around the longitudinal member. The longitudinal member includes a passage inside the member closed on one end and in communication with the pressurized gas source through the vertical shaft, and openings between the passage and the lower side of the longitudinal member. The elastomeric membrane has perforations which are spaced from the longitudinal member openings whereby the membrane substantially blocks the longitudinal member openings when pressure in the longitudinal member passage is no greater than the pressure outside the membrane.

In one form of this aspect of the present invention, the pressurized gas source is an inlet pipe connectable to a supply of pressurized gas, with the inlet pipe including a vertical portion with a joint therein. A rotation joint secures a downwardly open end of the inlet pipe to the upper end of the vertical shaft to provide a gas passage from the inlet pipe to the vertical shaft, whereby pipe lengths may be added to or removed from the vertical portion of the inlet shaft at the pipe joint to increase or decrease the depth of the blades in the body of liquid.

In a further form, a drive on the platform engages the vertical shaft for rotating the vertical shaft about its axis, with the drive being keyed to selectively allow axial movement of the vertical shaft therethrough and, in a still further form, the drive includes a ring gear around the vertical shaft with a key connection thereto, there being an inwardly facing ring gear surface supported on bearings, and a selectively driven pinion gear directly and drivably engaging the ring gear, the pinion gear being substantially smaller in diameter than the ring gear, and in a still further form, the ring gear includes a drive sleeve having the key connection to the vertical shaft.

In another further form, a cord and pulley lift mechanism is between the vertical shaft and a support frame above the drive, which the lift mechanism provides a mechanical advantage in lifting the vertical shaft. In a still further form, the cord comprises a wire rope.

In still another further form, all of the blades include a longitudinal member and elastomeric membrane as recited.

In yet another aspect of the present invention, an apparatus for introducing gas into a large body of liquid is provided, including a platform supported above the body of liquid, a pressurized gas source, a vertical shaft rotatable about its axis, the shaft being supported on the platform and having its lower end extending into the body of liquid, a plurality of blades submerged in the liquid and extending radially from the lower end of the shaft, and a drive on the platform engaging the upper end of the vertical shaft for rotating the vertical shaft. The blades communicate with the pressurized gas source through the vertical shaft whereby pressurized gas is ejected from the blades to the body of liquid. The drive is keyed to selectively allow axial movement of the vertical shaft therethrough, and includes a ring gear around the upper end of the vertical shaft with a key connection thereto, the ring gear having an inwardly facing surface supported on bearings, and a selectively driven pinion gear directly and drivably engaging the ring gear, the pinion gear being substantially smaller in diameter than the ring gear.

In one form of this aspect of the present invention, the pressurized gas source is an inlet pipe connectable to a supply of pressurized gas, where the inlet pipe includes a vertical portion with a joint therein. A rotation joint secures a downwardly open end of the inlet pipe to the upper end of the vertical shaft and provides a gas passage from the inlet pipe to the vertical shaft, whereby pipe lengths may be added to or removed from the vertical portion of the inlet shaft at the pipe joint to raise or lower the vertical shaft.

In another form of this aspect of the present invention, a plurality of floats support the platform, and the floats comprise buoyant containers having a removable cap thereon allowing access to adjust the ballast in the containers.

In still another form of this aspect of the present invention, the platform is supported on one end by a first float and on its opposite end by an intermediate portion of a longitudinal structural member supported on its opposite ends by second and third floats, wherein the platform and the structural member are configured in a "T" disposed in a substantially horizontal plane.

In yet another form of this aspect of the present invention, a plurality of floats on which the platform is supported, the floats comprising buoyant containers having a removable cap thereon allowing access to adjust the ballast in the containers.

In another form of this aspect of the present invention, the ring gear includes a drive sleeve having the key connection to the upper pipe length.

DETAILED DESCRIPTION OF THE INVENTION

Figure 1:
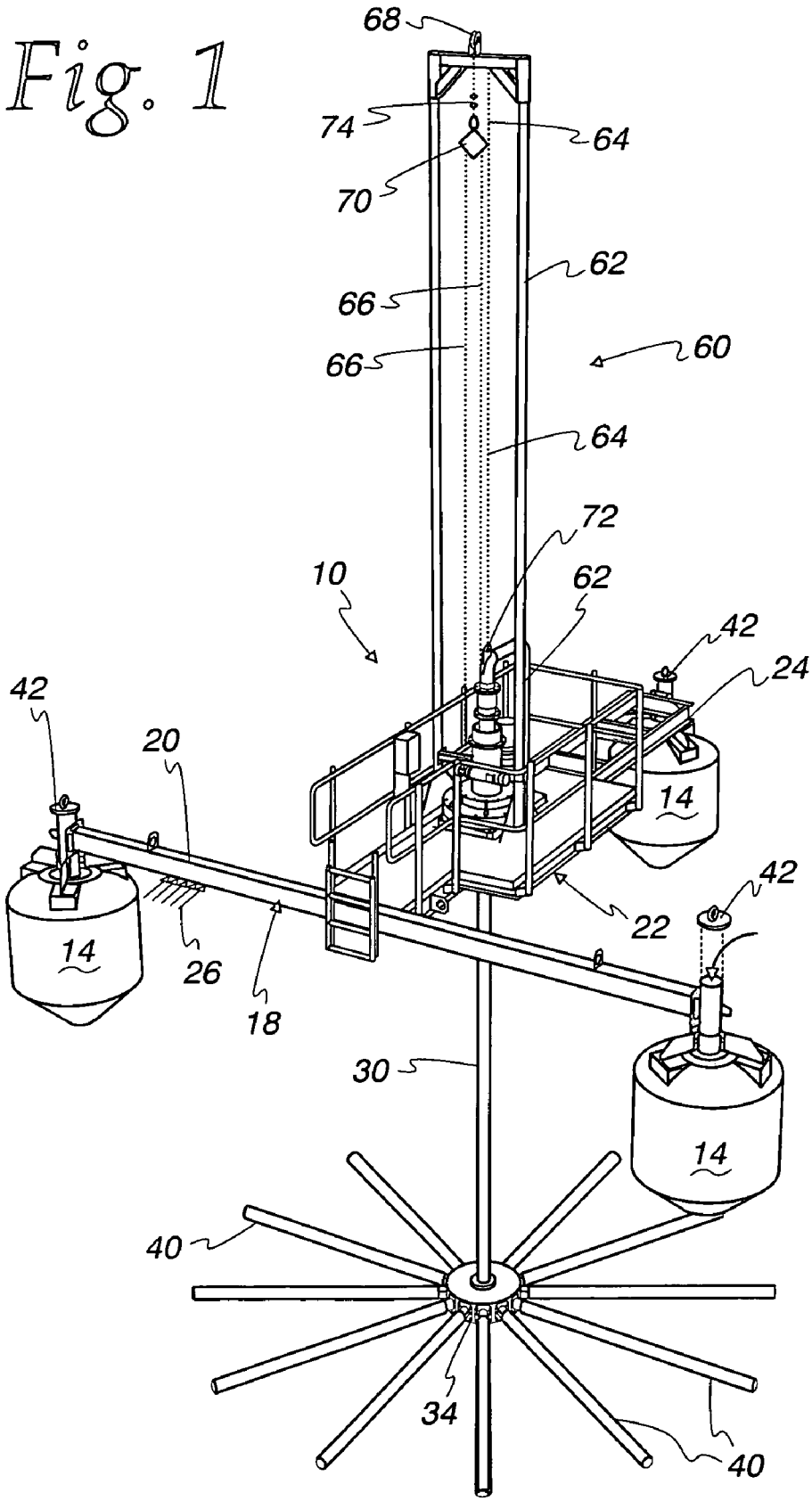
FIG. 1 is a perspective view of an aerating and mixing apparatus according to the present invention.

An apparatus 10 for introducing gas and dissolved gases into a large body of liquid and mixing the fluid of such a body in accordance with the present invention is shown in FIG. 1. The apparatus 10 may, for example, be advantageously used with large bodies of fluid such as in wastewater treatment to aerate and mix the wastewater to increase available oxygen to promote the growth of aerobic bacteria such as disclosed in U.S. Pat. Nos. 5,681,509 and 6,808,165 B1, the full disclosures of which are hereby incorporated by reference.

The apparatus 10 is supported between three floats 14 by a frame 18 which includes a first structural member 20 extending between two of the floats 14, with a platform 22 secured on one end to the structural member 20 and on the other to the third float 14 in a generally T configuration. The platform 22 and first structural member 20 are disposed in a substantially horizontal plane.

The structural member 20 may be a metal rectangular box beam of suitable dimension to support anticipated loading, and the platform 22 may similarly be formed of suitable supporting structural frame members (e.g., tube and C-channel members such as structural member 24). As contrasted with parallel truss supports used for similar apparatuses in the prior art, this frame 18 eliminates the need for expensive, multiple piece trusses which require fabricating, fitting and welding together. Moreover, this frame 18 is substantially stronger in withstanding horizontal forces (e.g., at 26) than were the truss supports of the prior art.

As described in greater detail below, the platform 22 supports a shaft 30 rotatable about a vertical axis which advantageously may be centrally located between the three floats 14, and effectively mounted to the supporting frame members. A hub 34 is disposed at the bottom of the shaft 30 and a plurality of blades 40 are secured to the hub 34 in a generally radial orientation.

As will be appreciated by those skilled in this art, the shaft 30 may advantageously be cylindrical so as to define a central passage through which air under pressure may be supplied to the hub 34, and then from the hub 34 to the blades 40. In operation, the shaft 30 supports the blades 40 so that they are horizontally oriented beneath the surface of the body of liquid on which the floats 14 are disposed and, as the shaft 30 is rotated, the blades 40 will sweep through the liquid and disperse the pressurized air into the liquid as described in greater detail below.

The three floats 14 may be advantageously provided with a removable cap 42 to facilitate easy adjustment of the float ballast (e.g., by adding metal shot, or drawing out metal shot) whereby the supported frame 18 may be readily supported in a level configuration, to thereby similarly support the shaft 30 in the desired vertical orientation (so that the blades 40 will sweep through a generally horizontal plane beneath the surface of the body of liquid). Difficult to use and expensive adjustable bracket connections to the floats such as used in the prior art are therefore not required.

Figure 2:
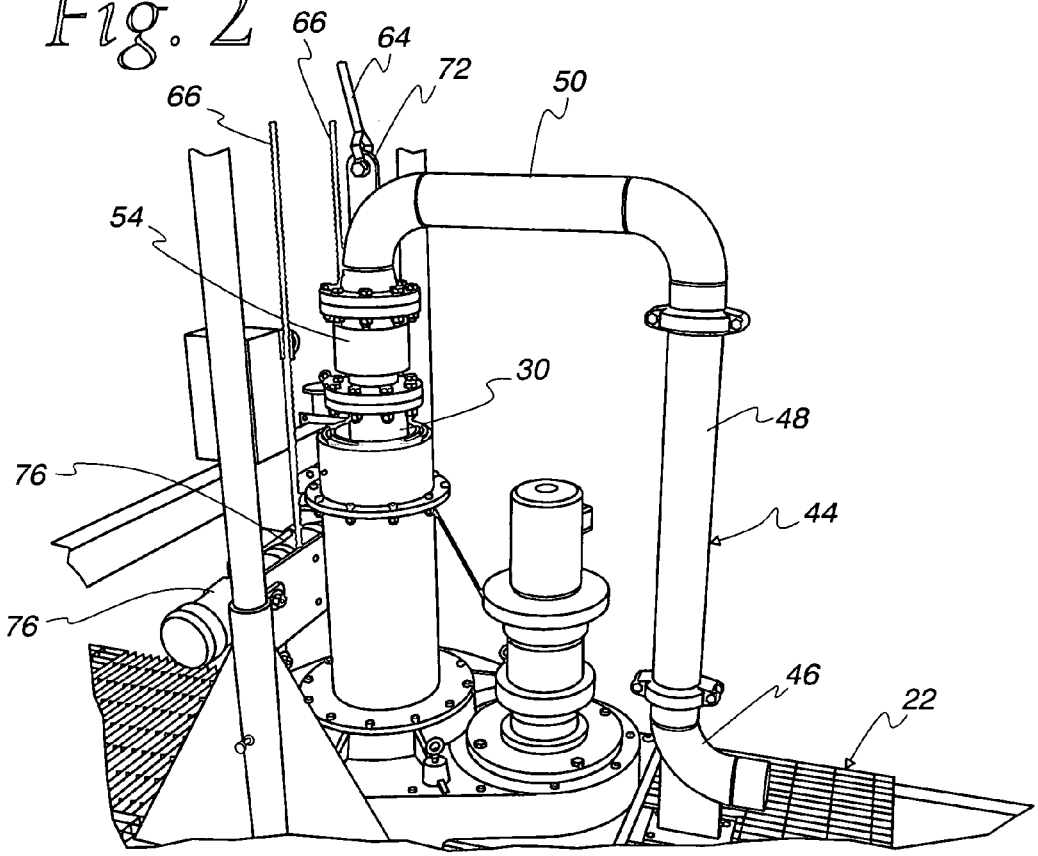
FIG. 2 is a partial perspective view of FIG. 1, illustrating the pressurized air connection.

Referring now specifically to FIG. 2, the previously referenced pressurized air may be advantageously supplied via a pipe 44 supported on the platform 22 and having an inlet pipe 46 which may be suitably connected to a compressor or other suitable source of pressurized air (not shown). The pipe 44 includes a vertical section 48 spaced from the vertical shaft 30 and extending upwardly from the inlet pipe 46, with a U-section 50 connected between the upper end of the vertical section 48 and a suitable rotation joint 54. The rotation joint 54 is disposed above, and connected to, the vertical shaft 30, whereby the vertical shaft 30 may rotate relative to the stationary pipe 44 while remaining connected to the pipe 44 so that pressurized air from the pipe 44 passes into the central passage in the shaft 30. This advantageous pipe 44 configuration for supplying pressurized air is easy to assemble and install, and thus may result in cost savings over prior pressurized air supplies for similar apparatuses requiring more crane time and expensive flexible duct connectors, hose clamps and flanges.

It should be appreciated that the length of the vertical section 48 may be adjusted by adding or removing pipe lengths, thereby raising or lowering the U-section 50, the rotation joint 54, and the attached vertical shaft 30, hub 34, and blades 40 as well. A suitable lifting structure 60 is provided to facilitate such operation, with an advantageous lifting structure being shown in FIG. 1 as including a vertical support frame 62 and a pair of cables or cords, such as wire ropes 64, 66. (It should be understood that, as used herein, cable and cord is intended to refer to any longitudinal member sufficiently flexible to be usable with a pulley and having tensile strength sufficient to support the structure intended to be lifted by the lifting structure 60.)

A first one of the ropes 64 (e.g., a ⅜ inch wire rope) is looped over a guide 68 on the top of the frame 62 and connected on one end to a suspended pulley 70 and on the other end to a bracket 72 (see FIGS. 1 and 2) which is suitably secured to the U-section 50 of the pressurized air supply. A pivoting connection 74 (see FIG. 1) may advantageously be provided in the connection of the one wire rope 64 to the pulley 70 to prevent twisting of the ropes 64, 66. Opposite ends of the other rope 66 (e.g., a 5⁄16 inch wire rope) are secured to a suitable winch 76 (see FIG. 2) which may be manually or power driven. It should thus be appreciated that operating the winch 76 to pull on the second cable 66 will provide a two to one mechanical advantage in the first cable 64 lifting the bracket 72 and attached structure. As a result, the U-section 50 and attached shaft 30 (and blades 40) can be easily raised for maintenance and/or adjustment (e.g., when adding or removing pipe sections to the vertical section 48 to adjust the depth of the blades 40, or when servicing the blades 40 which requires raising the blades 40 out of the body of liquid for access).

Figure 4:
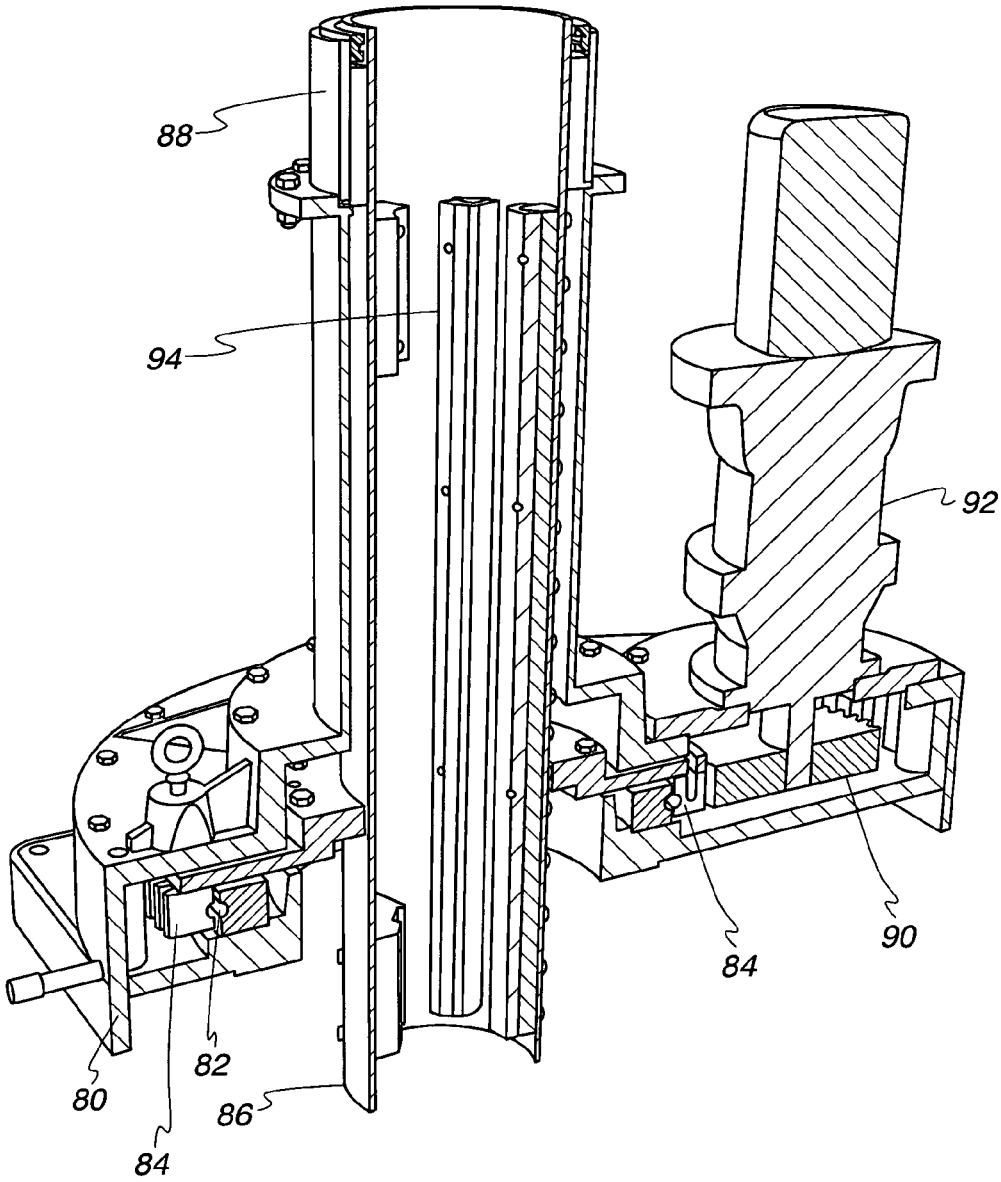
FIG. 4 is a cross-sectional view showing the drive for rotating the vertical shaft according to one feature of the present invention.

The vertical shaft 30 may also be advantageously rotatably driven as illustrated in FIG. 4. Specifically, a housing mount 80 is supported on the platform 22, and supports a bearing structure 82 about which a ring gear 84 is rotatably mounted. The bearing structure 82 may advantageously be a large rotational ball bearing integral to the ring gear 84, providing reduced friction and thereby decreasing the torque required to rotate the shaft 30 (and attached blades 40).

The ring gear 84 is suitably secured to a drive sleeve 86 which is itself rotatably supported in a tubular portion 88 of the housing mount 80. A gear reducer pinion gear 90 is driven by a suitable motor 92. Such an assembly is the PISTA® Gear drive available from Smith & Loveless, Inc. of Lenexa, Kans., U.S.A., and directly engages the ring gear 84 to rotate the ring gear 84 and drive sleeve 86 secured thereto. By omitting the use of drive chains such as have heretofore been used to rotatably drive the shaft of apparatuses of this type, chain wear and resulting premature failure may be avoided. Further, the cost of the required frequent maintenance of such chains may also be avoided. Moreover, the high overhung load created by the tension in such prior art chain drives may be avoided, thereby also avoiding failure resulting from such load, and avoiding the need for increased size gear reducers to minimize such failures.

A key guide block 94 is provided on the interior of the drive sleeve 86, and a drive spline on the vertical shaft 30 (not shown in FIG. 4) is slidably secured within the drive sleeve 86 to engage with the key guide block 94. As a result, the shaft 30 will be rotatably driven with the drive sleeve 86 when the tube 86 is rotated by the motor driven pinion gear 90. Moreover, when it is desired to raise or lower the shaft 30, the shaft 30 can be raised and lowered through the drive sleeve 86 by use of the lifting structure 60 as previously described.

Figure 3A:
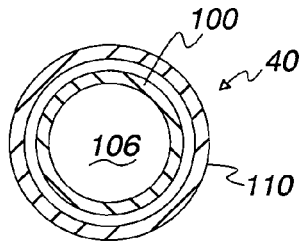
FIG. 3*a* is a cross-sectional view taken along line 3*a*-3*a* of FIG. 3 (wherein the slits in the membrane sleeve are not shown)
Figure 3:
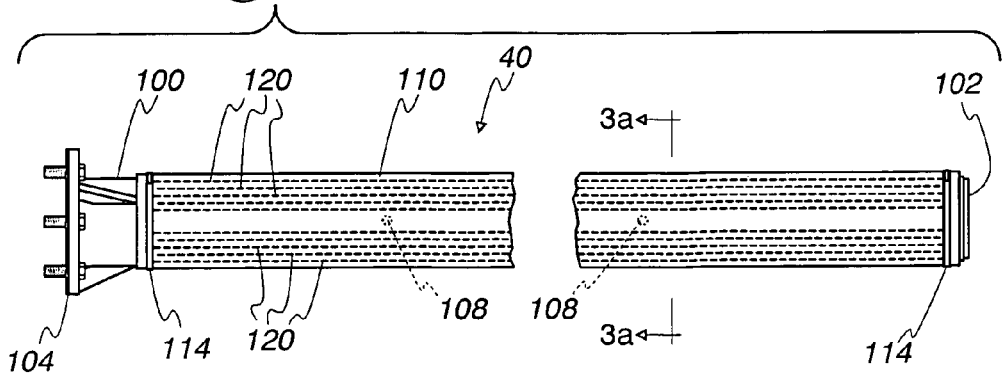
FIG. 3 is a top broken view of a blade incorporating one feature of the present invention.

One highly advantageous embodiment of the blades 40 of the present invention is illustrated in FIGS. 3 and 3*a*.

Each blade 40 may advantageously consist of a suitable tube 100, such as a stainless steel pipe 100 which is closed on its outer radial end 102 and has a mount 104 on the inner radial end adapted to secure to the hub 34 on the vertical shaft 30. Of course, the blade tube 100 could also be advantageously made of materials other than stainless steel which are sufficiently strong to withstand the expected loading over long periods of use. Moreover, the tube 100 includes a suitable interior passage 106 which receives pressurized air from the shaft 30, through the hub 34, and via an associated blade opening in the mount 104. Simply put, pressurized air input through pipe 44 passes through rotation joint 54, vertical shaft 30, and hub 34 to reach the interior of the blades 40. Air holes 108 are spaced along the bottom of the blade tube 40 and allow air to pass through the tube 100 from the interior passage 106. The air holes 108 may advantageously be sized to create a pressure drop which forces the air to exit the holes fairly evenly.

A membrane sleeve 110 is disposed around a substantial portion of the length of the blade tube 100, with clamps 114 securing opposite ends of the sleeve 110 to the outer surface of the blade tube 100. Depending upon the length of the blade tube 100, additional clamps may be provided along the sleeve 110, including in the middle of the sleeve 110. The sleeve 110 may advantageously be elastomeric with perforations 120 therethrough allowing passage of air through the sleeve 110. In one preferred form, perforations 120 are not provided in the portions of the sleeve 110 overlying the tube air holes 108.

In one configuration found to have been suitable for this blade structure, the tubes 100 are four inch diameter stainless steel tubes having ⅜ inch diameter air holes 108 at approximately four inch centerline spacing along the bottom of the tube 100 when mounted to the hub 34. The membrane sleeve 110 is an elastomeric material such as EPDM having about 2 mm (0.080 inch) thickness, and nominally about ⅛ inch larger in diameter than the tube 100 to facilitate sliding of the sleeve 110 on the tube 100 during assembly. The sleeve perforations 120 are lines of slits spaced apart about 1.5 mm, with the slits themselves being about 1.5 mm in length, and the lines of slits laterally spaced apart about 2 to 3 mm. About ⅝ inch circumferential sections extending longitudinally along the top and bottom of the membrane sleeve 110 do not have slits. Of course, it should be understood that many different configurations and sizes consistent with the blades of the present invention may be used, both within comparable applications and in different applications.

It should be appreciated that operation of the apparatus 10 of the present invention will allow the blades 40 to be rotated through the body of liquid at a desired depth, with the blades 40 making air bubbles in the submerged liquid. The air which exits the tube holes 108 fairly evenly will cause the membrane sleeve 110 to swell to a slightly larger diameter with the air evenly distribute under the membrane sleeve 110, and then exiting through the perforations (slits) 120, which create fine bubbles that are advantageously diffused into the body of liquid (e.g., wastewater).

Further, it should be appreciated that, in the event that air pressure in the blades 40 is lost while the blades are submerged, the pressure of the liquid outside the blades 40 will press the membrane sleeve 110 against the outer surface of the tube 100, and the unperforated portions of the sleeve 110 will function like a check valve to seal the tube air holes 108 and prevent the liquid from undesirably entering the blade tubes 100 and further will block undesirable particulates carried in the liquid from damaging/clogging the tubes 100 and tube air holes 108. Accordingly, when suitable air pressure is later reestablished in the blade tubes 100, that air will be able to flow under pressure out of the air holes 108 and then from the membrane perforations 120 to continue to generate the air bubbles desired for aeration. Moreover, it should be appreciated that this check valve function of the membrane sleeve 110 allows the depth of the blades 40 to be readily adjusted (as may be desired, e.g., seasonally) without requiring removal of the blades 40 from the liquid (since air pressure will intentionally be disconnected during such depth changes).

It should further be appreciated that the present invention provides improved blades 40 which are inexpensive, and easy to install and maintain. The membrane sleeve 110 serves both to facilitate aeration and to protect the blade tube 100. Moreover, even if the membrane sleeve 110 should be damaged in some manner, the blade 40 may be repaired by simply replacing the inexpensive membrane sleeve 110 and not the entire blade 40.

It should still further be appreciated that the lifting structure 60, and the direct drive of the ring gear 84 and pinion gear 90, the key guide block 94 and spline connection of the vertical shaft 30 to that drive, the pressurized air pipe 44 secured to the vertical shaft 30 by the rotation joint 54, and the secure support frame 18 with readily adjustable float 14, all combine to provide an inexpensive, reliable, and easy to maintain apparatus 10.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. An apparatus for introducing gas into a large body of liquid, comprising:

a platform supported above said body of liquid;

a pressurized gas source;

a vertical shaft rotatable about its axis, said shaft being supported on said platform and having its lower end extending into said body of liquid;

a plurality of blades submerged in said liquid and extending radially from said lower end of said shaft, at least one of said blades comprising a longitudinal member including a passage inside said member closed on one end and in communication with said pressurized gas source through said vertical shaft, and openings between said passage and the lower side of said longitudinal member, and an elastomeric membrane around said longitudinal member, said elastomeric membrane having perforations which are spaced from said longitudinal member openings whereby said membrane substantially blocks said longitudinal member openings when pressure in said longitudinal member passage is no greater than the pressure outside said membrane; and a drive on said platform engaging said vertical shaft for rotating said vertical shaft about its axis, said drive being keyed to selectively allow axial movement of said vertical shaft therethrough.

2. The apparatus of claim 1, wherein said drive comprises:

a ring gear around said vertical shaft with a key connection thereto, said ring gear having an inwardly facing surface supported on bearings; and a selectively driven pinion gear directly and drivably engaging said ring gear, said pinion gear being substantially smaller in diameter than said ring gear.

3. The apparatus of claim 2, wherein said ring gear includes a drive sleeve having said key connection to said vertical shaft.

4. The apparatus of claim 1, further comprising a cord and pulley lift mechanism between said vertical shaft and a support frame above said drive, said lift mechanism providing a mechanical advantage in lifting said vertical shaft.

5. The apparatus of claim 4, wherein said cord comprises a wire rope.

6. The apparatus of claim 1, wherein all of said blades comprise:

a longitudinal member including a passage inside said member closed on one end and in communication with said pressurized gas source through said vertical shaft, and openings between said passage and the lower side of said longitudinal member; and an elastomeric membrane around said longitudinal member, said elastomeric membrane having perforations which are spaced from said longitudinal member openings whereby said membrane substantially blocks said longitudinal member openings when pressure in said longitudinal member passage is no greater than the pressure outside said membrane.

7. An apparatus for introducing gas into a large body of liquid, comprising:

a platform supported above said body of liquid;

a pressurized gas source;

a vertical shaft rotatable about its axis, said shaft being supported on said platform and having its lower end extending into said body of liquid;

a plurality of blades submerged in said liquid and extending radially from said lower end of said shaft, said blades communicating with said pressurized gas source through said vertical shaft whereby pressurized gas is ejected from said blades to said body of liquid;

a drive on said platform engaging the upper end of the vertical shaft for rotating said vertical shaft, said drive being keyed to selectively allow axial movement of said vertical shaft therethrough, wherein said drive includes a ring gear around the upper end of the vertical shaft with a key connection thereto, said ring gear having an inwardly facing surface supported on bearings, and a selectively driven pinion gear directly and drivably engaging said ring gear, said pinion gear being substantially smaller in diameter than said ring gear.

8. The apparatus of claim 7, wherein said pressurized gas source is an inlet pipe connectable to a supply of pressurized gas, said inlet pipe including a vertical portion with a joint therein, and further comprising a rotation joint securing a downwardly open end of said inlet pipe to the upper end of said vertical shaft, said rotation joint providing a gas passage from said inlet pipe to said vertical shaft, whereby pipe lengths may be added to or removed from the vertical portion of said inlet shaft at said pipe joint to raise or lower the vertical shaft.

9. The apparatus of claim 7, further comprising a plurality of floats supporting said platform, said floats comprising buoyant containers having a removable cap thereon allowing access to adjust the ballast in said containers.

10. The apparatus of claim 7, wherein said platform is supported on one end by a first float and on its opposite end by an intermediate portion of a longitudinal structural member supported on its opposite ends by second and third floats, wherein said platform and said structural member are configured in a "T" disposed in a substantially horizontal plane.

11. The apparatus of claim 7, further comprising a plurality of floats on which said platform is supported, said floats comprising buoyant containers having a removable cap thereon allowing access to adjust the ballast in said containers.

12. The apparatus of claim 7, wherein said ring gear includes a drive sleeve having said key connection to said upper pipe length.

* * * * *